US006254819B1

(12) United States Patent
Chatterjee et al.

(10) Patent No.: US 6,254,819 B1
(45) Date of Patent: Jul. 3, 2001

(54) FORMING CHANNEL MEMBERS FOR INK JET PRINTHEADS

(75) Inventors: Dilip K. Chatterjee, Rochester; Donn B. Carlton, Hamlin; David L. Sime, Brockport; Syamal K. Ghosh, Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/354,950

(22) Filed: Jul. 16, 1999

(51) Int. Cl.[7] ..... H05B 6/00; H04R 17/00

(52) U.S. Cl. ..... 264/434; 264/619; 264/678; 29/25.35

(58) Field of Search ..... 264/434, 619, 264/678; 29/25.35; 347/68, 69

(56) References Cited

U.S. PATENT DOCUMENTS

| | | | |
|---|---|---|---|
| 5,028,937 | 7/1991 | Khuri-Yakub et al. . | |
| 5,227,813 | 7/1993 | Pies et al. . | |
| 5,248,998 | 9/1993 | Ochiai et al. . | |
| 5,311,218 | 5/1994 | Ochiai et al. . | |
| 5,365,645 | 11/1994 | Walker et al. . | |
| 5,598,196 | 1/1997 | Braun . | |
| 5,600,357 | 2/1997 | Usui et al. . | |
| 5,680,163 * | 10/1997 | Sugahara | 347/71 |
| 5,688,391 | 11/1997 | Hayes . | |
| 5,704,105 * | 1/1998 | Venkataramani et al. | 29/25.35 |
| 5,725,825 * | 3/1998 | Hotomi et al. | 264/434 |
| 5,758,396 * | 6/1998 | Jeon et al. | 29/25.35 |

FOREIGN PATENT DOCUMENTS 0 827 833 3/1998 (EP) .

* cited by examiner

*Primary Examiner*—Christopher A. Fiorilla
(74) *Attorney, Agent, or Firm*—Raymond L. Owens

(57) ABSTRACT

A method of making an ink jet printer channel member for use in ink delivery includes molding piezoelectric ceramic powders into a slab in the green state having top and bottom surfaces, forming alternating grooves on the top and bottom surfaces of the green state slab which provides peaks and valleys in opposite sides of the green state slab, wherein the valleys in the top surface are disposed in an offset relationship to the peaks in the bottom surface, sintering and poling the grooved green state slab; and forming electrically conductive surfaces on the exposed top and bottom surfaces of the sintered state slab. A slot is then cut through the top conductive layer in each of the valleys in the top surface of the grooved sintered green state slab. An orifice plate is positioned over the conductive surface on the top peak surfaces of the slotted sintered slab and a substrate on the conductive surface on the bottom peak surfaces to produce the ink jet printer channel member.

3 Claims, 5 Drawing Sheets

FORMING CHANNEL MEMBERS FOR INK JET PRINTHEADS

FIELD OF THE INVENTION

This invention relates to a method of making channel members for ink jet printheads.

BACKGROUND OF THE INVENTION

Ink jet printheads made from a piezoelectric material are used to selectively eject ink droplets onto a receiver to form an image. Within the printhead, the ink may be contained in a plurality of channel members and energy pulses are used to actuate the printhead channel members causing the droplets, which form the reservoirs of ink to be ejected on demand or continuously, through an orifice plate over the channel member.

In one representative configuration, a piezoelectric ink jet printing system includes a body of piezoelectric material defining an array of parallel open topped channel members separated by walls. In the typical case of such an array, the channel members are micro-sized and are arranged such that the spacing between the adjacent channel members is relatively small. The channel walls have metal electrodes on opposite sides thereof to form shear mode actuators for causing droplets to expel from the channel members. An orifice defining structure includes at least one orifice plate defining the orifice through which the ink droplets are ejected, and is bonded to the open end of the channel members. In operation of piezoelectric printheads, ink is directed to and resides in the channel members until selectively ejected therefrom. To eject an ink droplet through one of the selected orifices, the electrodes on the two side wall portions of the channel in operative relationship with the selected orifice are electrically energized causing the side walls of the channel to deflect into the channel and return to their normal undeflected positions when the applied voltage is withdrawn. The driven inward deflection of the opposite channel wall portions reduces the effective volume of the channel thereby increasing the pressure of the ink confined within the channel to force few ink droplets, 1 to 100 pico-liters in volume, outwardly through the orifice. Piezoelectric ink jet printheads are described in detail in U.S. Pat. Nos. 5,598,196; 5,311,218; 5,365,645, 5,688,391, 5,600, 357, and 5,248,998.

The use of piezoelectric materials in ink jet printheads is well known. Most commonly used piezoelectric material is lead-zirconate-titanate (PZT) ceramic, which is used as a transducer by which electrical energy is converted into mechanical energy by applying an electric field across the material, thereby causing the piezoelectric ceramic to deform. The degree of deformation of the piezoelectric materials depend on several factors, including chemical composition, grain size of the material, and the electrode configuration of the transducers.

Under previous methods of making piezoelectric ink jet printheads, a dense sintered slab of piezoelectric ceramic such as PZT in which channel members/grooves are to be formed is poled. Poling makes the material piezoelectrically deflectable or "active", by imparting a pre-determined voltage widthwise across the piezoelectric ceramic slab in a selected poling direction of the internal channel side wall sections later to be created in the poled ceramic body section by forming a spaced series of parallel grooves in channel members. These grooves in the channel members are generally formed by sawing, laser cutting or etching process. This current process of poling a bulk piezoelectric ceramic material and later fabricating micro-sized channel members by sawing or other processes is discussed in detail in U.S. Pat. Nos. 5,227,813 and 5,028,937, and in EP 827833. This process of forming channel members is not only time consuming and expensive, but also is amenable to many defects generated during cutting the channel members or forming the channel members thereby reducing the throughput and increasing the unit manufacturing cost. Furthermore, mechanical damages caused during sawing or laser cutting also are detrimental to the piezoelectric characteristics of the material.

SUMMARY OF THE INVENTION

Accordingly, it is an object of the present invention to provide a method of making piezoelectric ceramic ink jet printhead forming channel members, which will eliminate time consuming and costly processes of making channel members/cavities which form ink reservoirs.

These objects are achieved in a method of making an ink jet printer channel member for use in ink delivery comprising the steps of:

(a) molding piezoelectric ceramic powders into a slab in the green state having top and bottom surfaces;

(b) machining the top and bottom surfaces of the green state slab to form alternating grooves on the top and bottom surfaces of the green state slab which provide peaks and valleys in opposite sides of the green state slab, wherein the valleys in the top surface are disposed in an offset relationship to the peaks in the bottom surface;

(c) sintering and polling the grooved green state slab;

(d) forming electrically conductive surfaces on the exposed top and bottom surfaces of the sintered green state slab;

(e) cutting a slot through the top conductive layer in each of the valleys in the top surface of grooved sintered green state slab; and (f) positioning an orifice plate over the conductive surface on the top peak surfaces of the slotted sintered slab and a substrate on the conductive surface on the bottom peak surfaces to produce the ink jet printer channel member.

ADVANTAGES

Forming green machined slabs for print head application has numerous advantages. The diamond sawing, which is essential for forming channel members in sintered, dense materials, particularly ceramics, causes defects, such as chipping and unevenness of the channel member walls. In the conventional method of channel member formation in piezoelectric materials, the poled materials are subjected to diamond sawing. This produces a heat-affected zone on the channel member walls, where the composition of the material changes due to heat generated by sawing. The dipole characteristics of this heat-affected zone will be different than that of the interior, producing a different and variable piezoelectric coefficient. This invention facilitates the poling of the piezoelectric channel members. It also eliminates time consuming and batch saw processing.

DETAILED DESCRIPTION OF THE PREFERRED EMBODIMENT

The present invention provides a method of making ink jet piezoelectric channel members using green ceramic materials, particularly piezoelectric ceramic materials and green machining to form a series of closely spaced micro-sized parallel grooves on both sides of the green ceramic slab. These channel members form the reservoirs of ink for the printheads. The term "green" refers to the state of the piezoelectric ceramic material before sintering. Normally, the ceramic powder, after appropriate processing such as size classification, agglomeration, and binder mixing, is compacted to a preferred shape and then sintered at a high temperature where diffusion assisted densification occurs. The term "green machining" refers to any shaping operation done on the unsintered slab of ceramic material. It should be apparent to skilled artisans that a particular method of compacting the powder is not critical to form the green slab. The green block can be produced by such molding methods as cold uniaxial pressing or dry pressing, wet bag cold isostatic pressing, dry bag cold isostatic pressing, injection molding, or by processes such as cold extrusion and tape casting. These compaction processes are well known by those persons experienced in ceramic art. The green piezoelectric slabs with grooves are sintered at a predetermined temperature to densify the material. The grooved ceramic slab is then electrically poled to make it piezoelectrically active, electrically conductive material are coated over the exposed top and bottom surfaces of the sintered piezoelectric member to form drive electrodes. Slots are then cut through the conductive layer of the top surface in the groove to form electrodes which are physically separated from each other. The open end of the sintered slab is covered with an orifice plate and the other end is mounted on a substrate.

Figure 1:
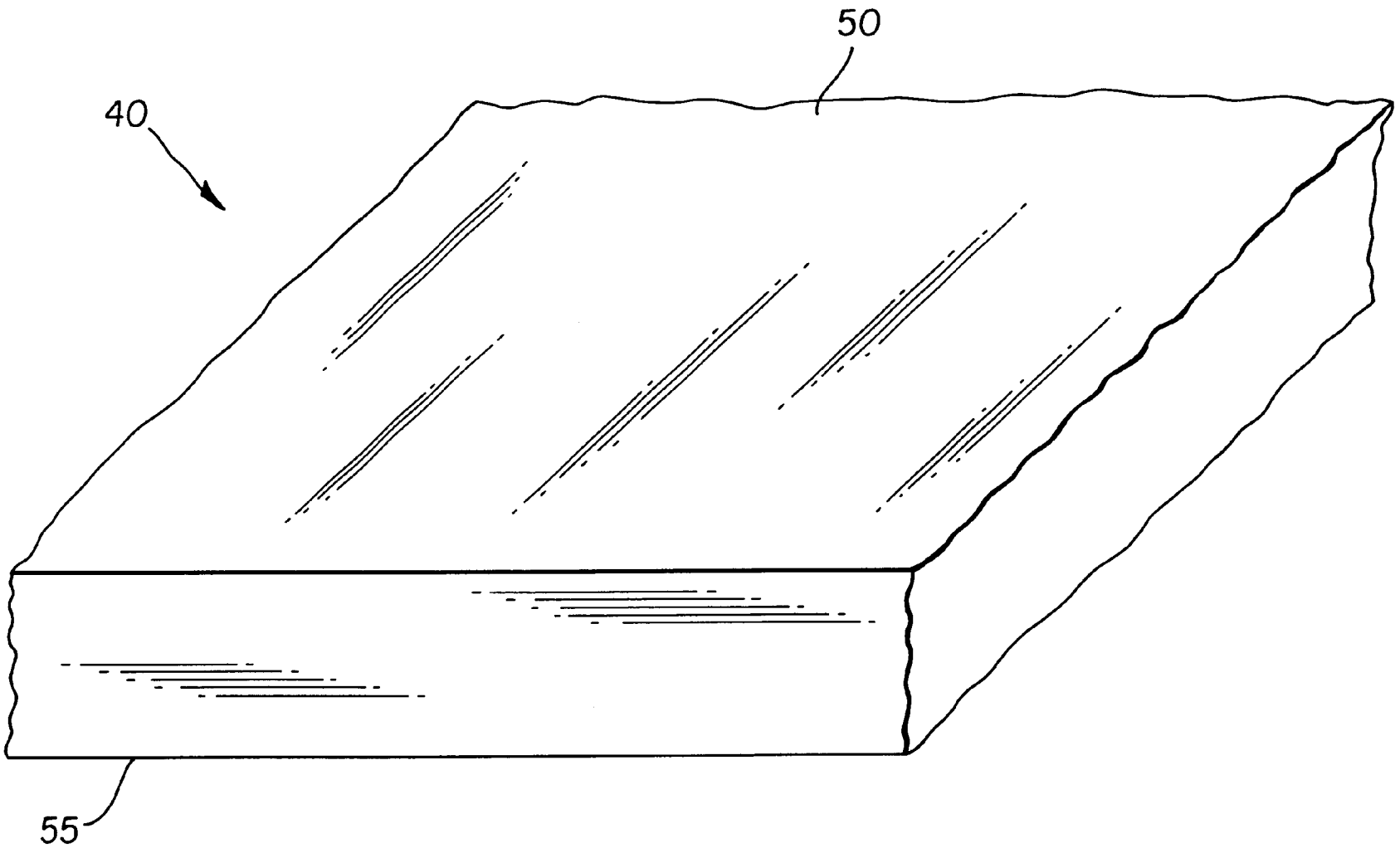
FIG. 1 is an enlarged isometric of a green ceramic slab.

FIG. 1 shows a slab 40 of green piezoelectric ceramic material formed by any of the cold compaction processes described earlier. In this invention, a tape casting process is used for forming the green ceramic slab 40, and more particularly, a PZT piezoelectric ceramic slab is described. In the tape casting process, a ceramic slurry comprising lead-zirconate-titanate having chemical composition $Pb(Zr_2Ti_{1-z})O_3$, where z=0.52 to 0.55, and multi-component organic additives is formulated. The additives include a binder, a plasticizer, a dispersant/wetting agent and an antifoaming agent, which are poured into a mold held on a platen to form the green ceramic slab 40. As shown in FIG. 1, the slab 40 has a flat top surface 50 and a flat bottom surface 55. Examples of organic binders which can be used in the formation of ceramic slurry for tape casting are polyvinyl alcohol, polyvinyl acetate, polyvinyl chloride, polyvinyl butryal and polystyrene. The preferred dispersant and/or wetting agent used in the formation of ceramic slurry is isooctylphenylpolyethoxyethanol. The preferred defoaming agent used in the formation of ceramic slurry is tributylphosphate. The following is a preferred specific formulation of the ceramic slurry:

| | |
|---|---|
| Lead-zirconate-titanate powder | 100 g. |
| Methyl ethyl ketone/ethanol 50:50 mixture (solvent) | 25 g. |
| Menhaden fish oil (dispersant) | 0.8 g. |
| Polyethylene glycol (plasticizer) | 7.5 g. |
| Polyvinyl alcohol (binder) | 15 g |
| Trinutylphosphate (defoaming agent) | 1.5 g. |
| Isooctylphynylpolyethoxyethanol (wetting agent) | 1 g. |

A particularly useful Menhaden fish oil that was used had commercial name, Deflock D-3™and was produced by Spencer Kellogg, Inc. of Buffalo, N.Y.

The ceramic powder, methyl ethyl ketone/ethanol 50:50 mixture, and Menhaden fish oil were added to a ball mill and milled for at least six hours to achieve thorough mixing. The resulting ball milled mixture was then placed in a mixer and mixed with the remaining ingredients listed above for at least twelve hours. The resulting ceramic slurry was then allowed to age for at least twelve hours and subsequently de-aired. Viscosity of the ceramic slurry was checked and was maintained at 1000 to 1200 MPa. The ceramic slurry was then cast into a moving carrier mold (not shown) made of materials selected from cellulose acetate, steel, aluminum or other metals, and spread to a controlled and predetermined thickness with the edge of a doctor blade to form the piezoelectric green ceramic slab 40. After the casting process, most of the solvent in the green ceramic slab 40 was evaporated away slowly by flowing air over the green ceramic slab 40. The next step of the invention involves removing the dry piezoelectric green ceramic slab 40 along with the mold from the platen (not shown) of the tape casting machine. The next steps involved debinding of the piezoelectric green ceramic slab 40 at about 450° C. to remove most of the organic additives, and transferring to the green machining station.

Figure 2:
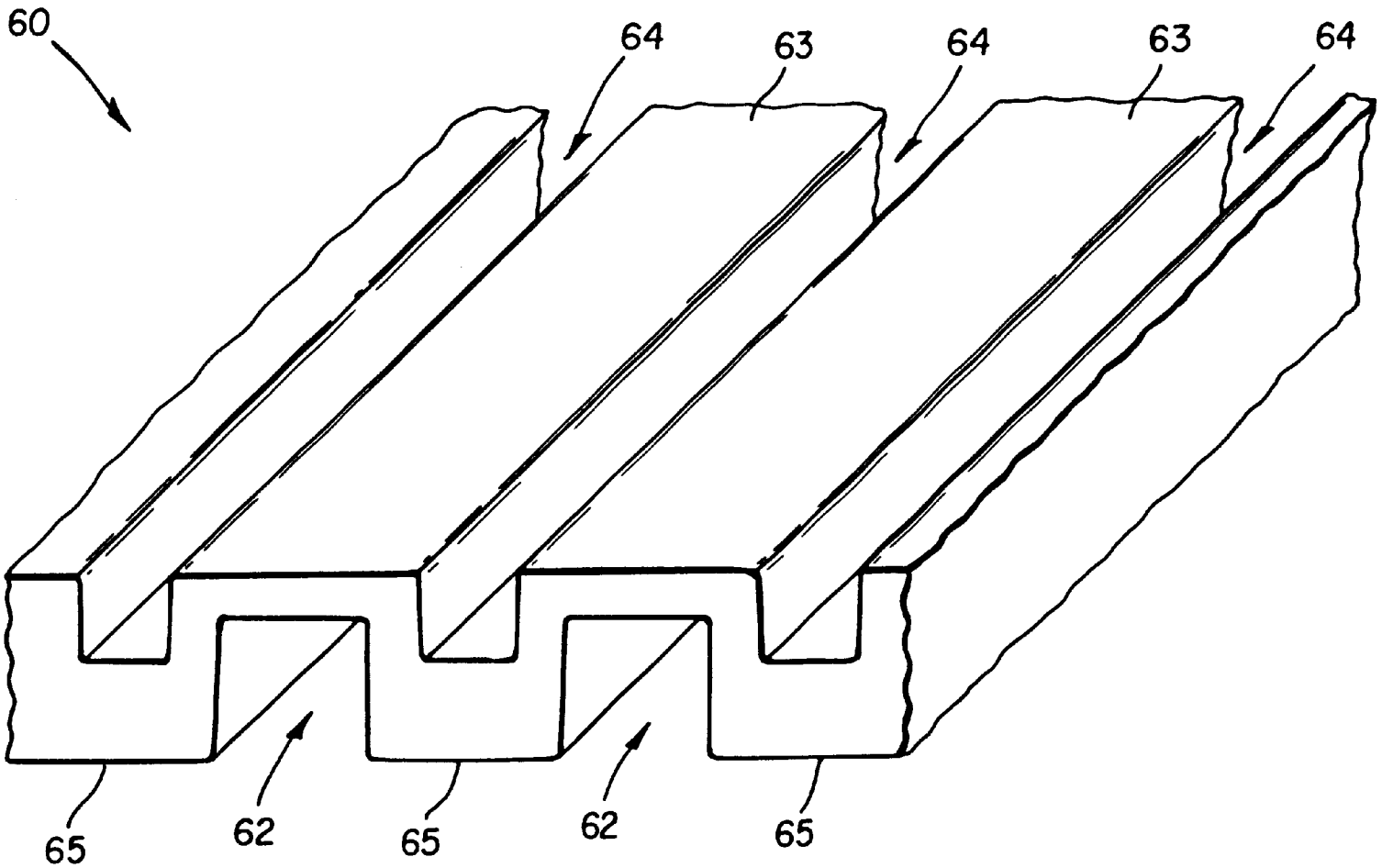
FIG. 2 is an enlarged partial isometric of the green ceramic slab of FIG. 1 after being formed with grooves.

In accordance with the present invention, green machining of the green ceramic slab 40 forms a series of micro-sized parallel grooves 62 in the bottom surface 55 and a series of micro-sized parallel grooves 64 in the top surface 50 (see FIG. 2). In accordance with the present invention, the grooves 62 and 64 on the top surface 50 and the bottom surface 55, respectively, of the green ceramic slab 40 provide peaks and valleys in opposite sides of the green ceramic slab 40. As shown in FIG. 2, the valleys in the top surface 50 are disposed in an offset relationship to the peaks in the bottom surface 55. The grooves 62 will serve as ink reservoirs for the completed channel member. The micro-sized grooves 64 help create parallel walls in each groove 62 so that each groove 62 can be individually addressed and actuated to expel the ink to the receiver.

The green machining of the piezoelectric green slab 40 was performed using a Bridgeport Vertical Mill operated in the speed rage of 700 to 1500 RPM, most preferred speed was about 1000 RPM. This milling machine was retrofitted with blades having 3.175 cm in diameter and 0.005 cm to 0.02 cm thickness, most preferred rage of thickness was 0.01 cm to 0.015 cm. The feed rate of the mill was adjusted to 10 to 40 cm per minute, the most preferred feed rate was 10 to 25 cm per minute.

After green machining of the green ceramic slab 40, the slab 40 is sintered in the range of 1200 to 1600° C., most preferred range is 1200 to 1400 ° C. in air for about 2 hours to obtain a highly dense sintered piezoelectric slab 60. FIG. 2 shows a partial isometric of the sintered piezoelectlic slab

60. After sintering, the width of each groove 62 may vary from 50 to 500 $\mu$m and the height of each groove 62 may vary from 100 to 1000 $\mu$m. The width of each groove 64 may vary from 50 to 200 $\mu$m and the depth of each groove 64 may vary from 50 to 300 $\mu$m.

To provide for poling of the sintered piezoelectric slab 60, two heavy duty electrodes in the form of metal plates (not shown) are placed on parallel first and second surfaces 63 and 65, respectively, of the sintered piezoclectric slab 60. The two electrodes are clamped tightly, immersed in a bath of oil having high dielectric constant (1,000 to 2500) and a very high voltage is applied across the electrodes to pole the piezoelectric ceramic material along the thickness of the sintered piezoelectric slab 60. The reason for immersing the part in high dielectric oil during poling is that the applied electric field is not distorted and the sintered piezoelectric slab 60 is poled uniformly.

Figure 3:
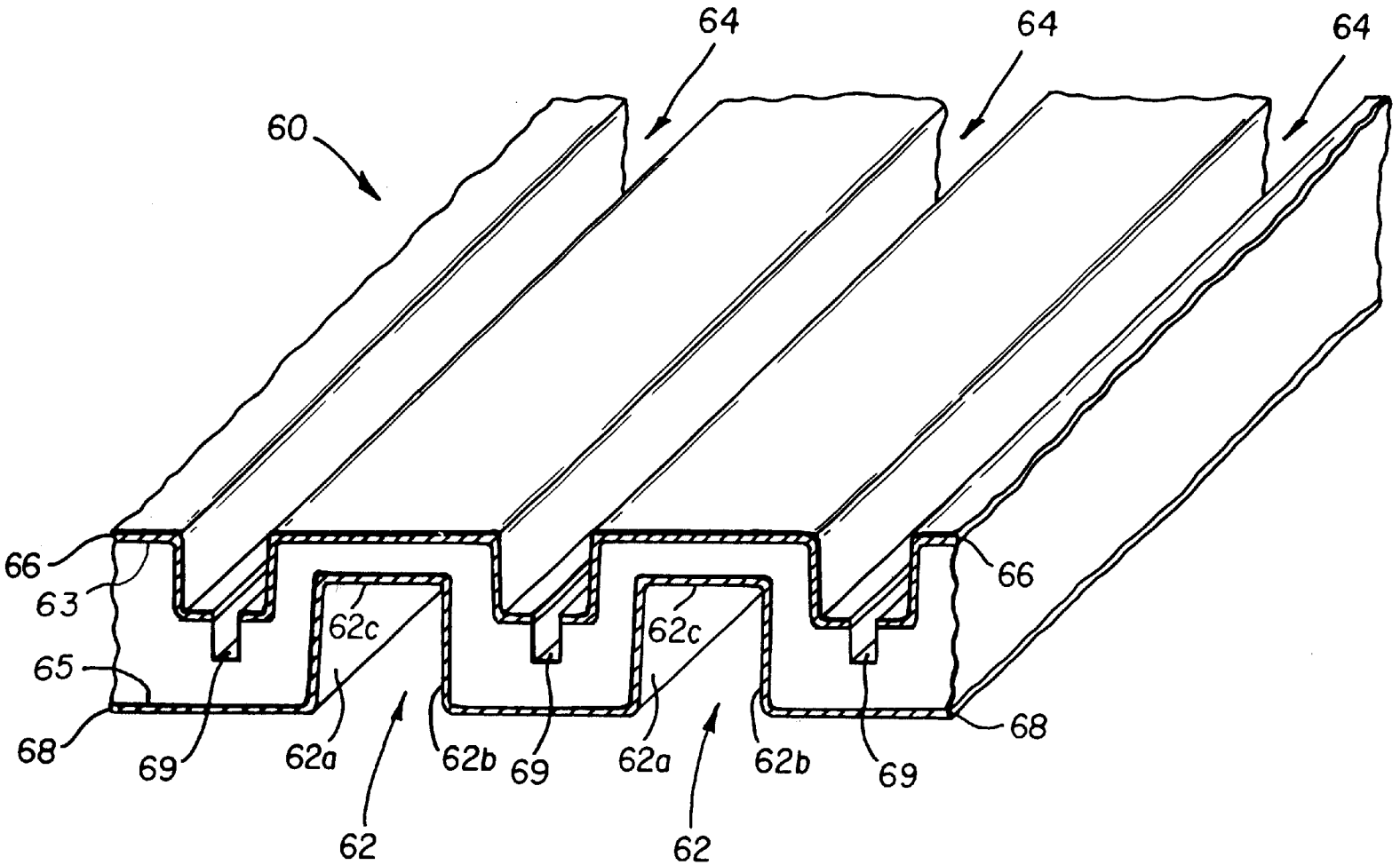
FIG. 3 is an enlarged partial isometric of the sintered green ceramic slab after slots have been cut therein.

Referring to FIG. 3, a partial isometric of the sintered piezoelectric slab 60 with grooves 62 and 64 is show wherein electrically conductive layers in the form of coatings 66 and 68, respectively, have been deposited on both the parallel first and second surfaces 63 and 65, respectively, and in the grooves 62 and 64, respectively. These conductive coatings will serve as electrodes as will shortly be explained. The conductive coating layers 66 and 68 can be deposited by various deposition techniques, such as vapor deposition or sputtering. The materials can be, for example, gold, silver, palladium, and alloys thereof.

As shown in FIG. 3, the bottom portion of each micro-sized groove 64 was cut with a saw or laser to form slots 69 which help electrically separate the grooves 62 from each other. These slots 69 help improve the flexibility of the side walls 62*a* and 62*b* and the bottom wall 62*c* of the grooves 62 for ease of ink ejection.

Figure 4:
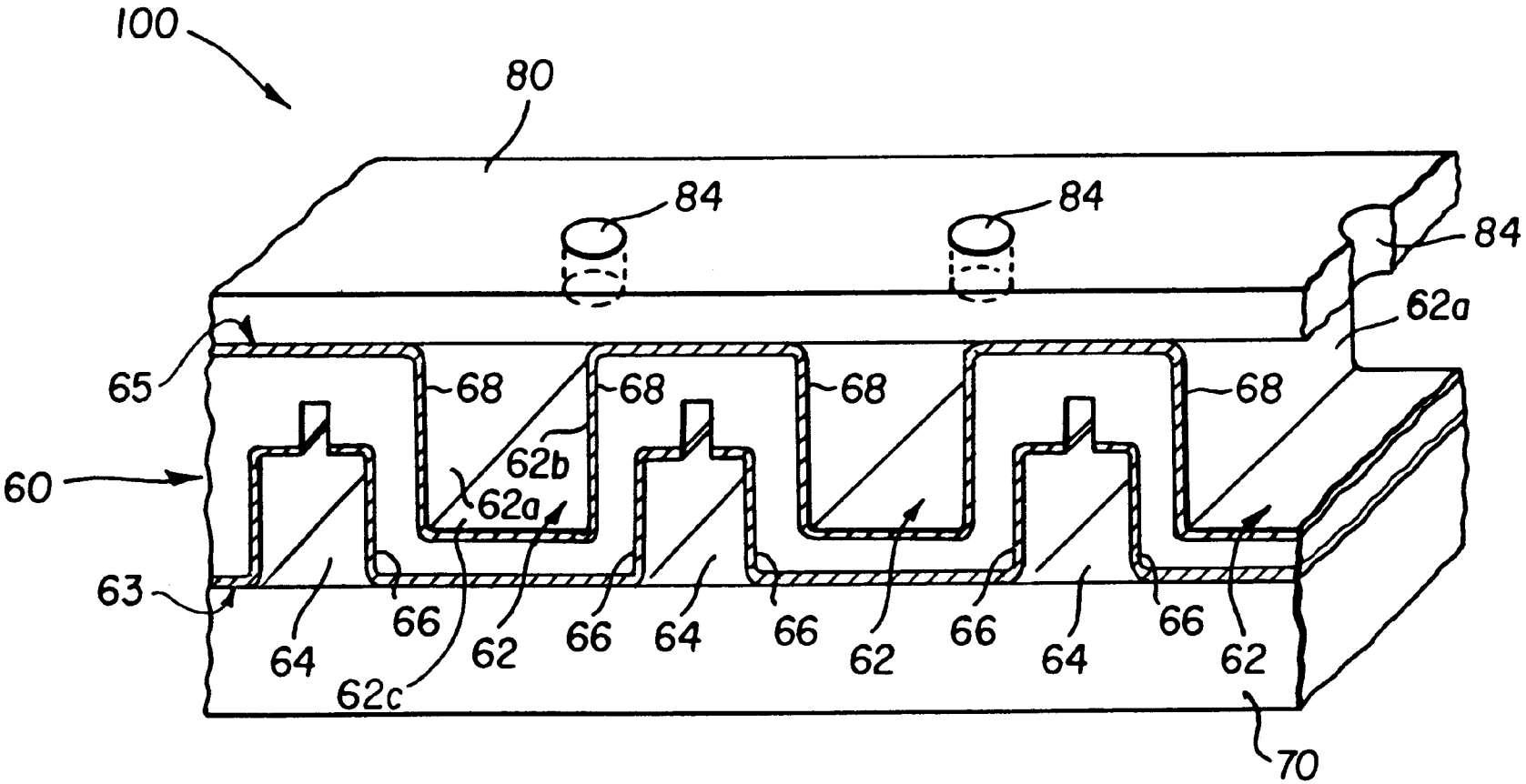
FIG. 4 is an enlarged partial isometric of a completed ceramic channel member.

Referring now to FIG. 4, a partial isometric of an assembled ink jet ceramic piezoelectric channel member 100 according to the present invention is shown. The first surface 63 of the sintered piezoelectric slab 60 is bonded to a non-conductive substrate or base plate 70 and the bottom surface 65 of the sintered piezoelectric slab 60 is bonded with an orifice plate 80, such as nickel. The orifice plate 80 includes a row of orifices 84 which are aligned with the open ends of the grooves 62. The electrodes 66 and 68 on the opposite sides of the walls 62*a* and 62*b* are electrically connected such that a microprocessor (not shown) can address each groove 62 individually to cause the inward deflection thereby expelling ink droplets to the receiver.

Figure 5:
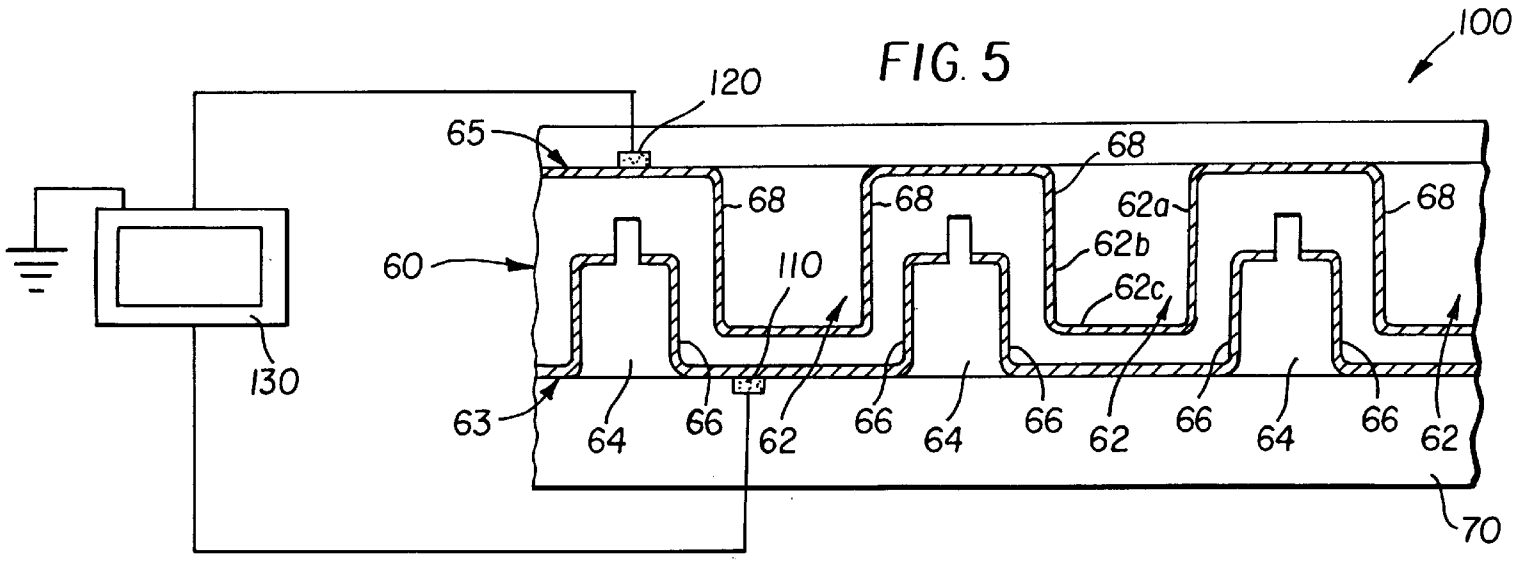
FIG. 5 shows the completed ceramic channel member of FIG. 4 including electrode pads for connecting the conductive coating layers.

FIG. 5 shows the assembled ink jet ceramic piezoelectric channel member 100 of FIG. 4 including electrode pads 110 and 120 for connecting the conductive coating layers 66 and 68, respectively, for piezoelectric actuation of the grooves 62. The electrode pad 120 is commonly connected to the conductive coating layer 68 and is a ground potential. A plurality of electrode pads 110 are connected to the conductive coating layers 66 in such a way that individual grooves 62 are energized one or more at a time with the use of a microprocessor controlled power source 130 and ink droplets are expelled out from respective orifices 84 by causing an inward deflection of the walls of the grooves 62 (as shown in FIG. 6).

Figure 6:
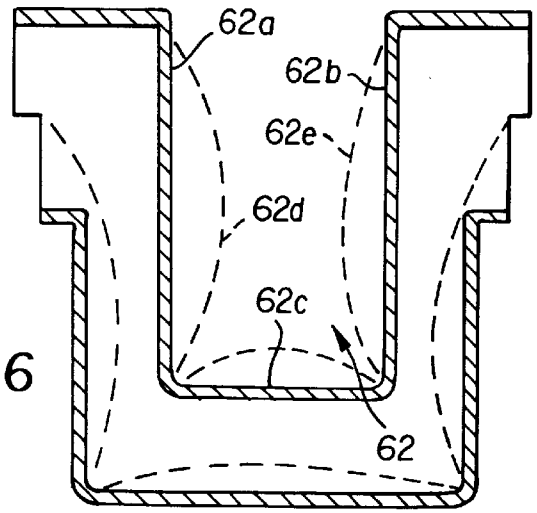
FIG. 6 is a cross-sectional view of one groove showing positions of the walls before and after actuation to expel ink droplets.

FIG. 6 is a cross-sectional view of one groove 62 showing exemplary positions of the side walls and the bottom wall of the groove 62 before actuation (shown in solid lines) and after actuation (shown in dotted lines) to expel ink droplets. As shown, reference numerals 62*a*, 62*b*, and 62*c* indicate the positions of the side walls and the bottom wall before actuation, and reference numerals 62*d*, 62*e*, and 62*f* indicate the positions of the side walls and the bottoms walls after actuation, respectively.

EXAMPLE I

Fully sintered, hot isostatically pressed PZT material (Material Code HSC by Sumitomo Corporation, Japan) was sawed using a diamond impregnated saw, by the methods described earlier. The minimum width of the grooves were in the range of about 60 to 80 microns. However, the surface finish of the channel surfaces were also in the range of 60 to 80 microns, which is considered to be poor surface finish. The saw cut surfaces of the sintered material had numerous micro-cracks. Each diamond impregnated saw could cut about 10 grooves on the sintered material block.

EXAMPLE II

Tape cast and Binder Coagulation Cast (BCC) PZT material was made from piezoelectric powder obtained from PiezoKinetics, Pennsylvania. These green tape cast and binder coagulation cast materials were sawed using steel blades by the methods described herein in accordance with the present invention. The blades with 0.015 cm diameter produces grooves 62 having a width of about 120 microns, which after sintering, shrunk to a width of about 95 microns. If the width of the saws was reduced to 0.01 cm, grooves 62 of about 90 microns in width were produced in the green state, which when sintered, reduced to about 60 microns. The surfaces of the walls of the grooves had surface finish in the range of 10 to 20 microns. No micro-cracks and material full-outs were observed on the green machined and sintered surfaces. Each steel blade produced about 50 grooves 62.

In view of the above description, it is understood that modifications and improvements will take place to those skilled in the art which are well within the scope of this invention. The above description is intended to be exemplary only wherein the scope of this invention is defined by the following claims and their equivalents.

PARTS LIST

40 piezoelectric green ceramic material slab
50 top surface
55 bottom surface
60 sintered piezoelectric slab
62 micro-sized groove
62*a* groove side wall
62*b* groove side wall
62*c* groove bottom wall
62*d* groove side wall after actuation
62*e* groove side wall after actuation
62*f* groove bottom wall after actuation
63 first surface
64 micro-sized groove
65 second surface
66 conductive coating layers
68 conductive coating layers
69 slot
70 base plate
80 orifice plate
84 orifice
100 ceramic piezoelectric channel member
110 electrode pad
120 electrode pad
130 microprocessor controlled power source

What is claimed is:

1. A method of making an ink jet printer channel member for use in ink delivery comprising the steps of:

(a) molding piezoelectric ceramic powders into a slab in the green state having top and bottom surfaces;

(b) machining the top and bottom surfaces of the green state slab to form alternating grooves on the top and bottom surfaces of the green state slab which provide peaks and valleys in opposite sides of the green state slab, wherein the valleys in the top surface are aligned with the peaks in the bottom surface;

(c) sintering and poling the grooved green state slab;

(d) forming electrically conductive surfaces on the exposed top and bottom surfaces of the sintered green state slab;

(e) cutting a slot through each of the valleys in the top surface of grooved sintered green state slab; and (f) positioning an orifice plate over the conductive surface on the top peak surfaces of the slotted sintered slab and a substrate on the conductive surface on the bottom peak surfaces to produce the ink jet printer channel member.

2. The method of claim 1 wherein the molding step includes:

(i) pouring a slurry of piezoelectric ceramic powder and multi-component binders into a mold; and (ii) drying the molded slurry to provide the green state slab.

3. The method of claim 1 wherein the electrically conductive surfaces are formed from a material selected from the group consisting of gold, silver, chromium, aluminum or alloys thereof.

* * * * *